US007708339B2

(12) United States Patent
Zapater

(10) Patent No.: US 7,708,339 B2
(45) Date of Patent: May 4, 2010

(54) CANOPY FRAME PARTICULARLY APPLICABLE TO DECK CHAIRS, GARDEN CHAIRS, BEACH CHAIRS AND THE LIKE

(76) Inventor: Raul Emilio Zapater, Cabildo 480, GRAL Pacheco, Provincia de Buenos Aires (AR)

( * ) Notice: Subject to any disclaimer, the term of this patent is extended or adjusted under 35 U.S.C. 154(b) by 0 days.

(21) Appl. No.: 11/698,553

(22) Filed: Jan. 26, 2007

(65) Prior Publication Data

US 2007/0187999 A1 Aug. 16, 2007

(30) Foreign Application Priority Data

Jan. 27, 2006 (AR) ..... 20060100319

(51) Int. Cl.
*A47C 29/00* (2006.01)
*E04H 15/02* (2006.01)

(52) U.S. Cl. ..... 297/184.11; 297/184.15; 135/96; 135/161

(58) Field of Classification Search ..... 297/184.15, 297/184.1, 184.11, 184.14, 184.16; 135/96, 135/87, 95, 124, 126, 88.01, 88.05, 88.06, 135/88.07, 88.08, 88.15, 88.16, 90, 120.4, 135/161, 906, 127, 125, 138, 901
See application file for complete search history.

(56) References Cited

U.S. PATENT DOCUMENTS 2,771,125 A * 11/1956 Dobbins ..... 297/184.15
4,164,233 A * 8/1979 McAndrew ..... 135/88.08
4,295,481 A * 10/1981 Gee ..... 52/64
4,404,980 A * 9/1983 Wade ..... 135/123
4,779,294 A * 10/1988 Miller ..... 135/121
5,168,889 A * 12/1992 Diestel ..... 135/88.01
5,494,329 A * 2/1996 Gonzalez et al. ..... 297/184.13
D384,125 S * 9/1997 Griffin ..... D21/834
5,823,217 A * 10/1998 Rice ..... 135/124
5,927,311 A * 7/1999 Jager ..... 135/124

(Continued)

*Primary Examiner*—David Dunn
*Assistant Examiner*—Danielle Jackson
(74) *Attorney, Agent, or Firm*—Defillo & Associates, Inc.; Evelyn A. Defillo

(57) ABSTRACT

A canopy frame particularly applicable for deck chairs, garden chairs, beach chairs and the like, which can easily be assembled or disassembled in the place itself to be used or carried by the user which comprises a set of flexible rods coupled with each other in an axial way and which define respective side poles which are extended respectively like an arc on opposite sides of the chair or deck chair and separated between them by a distance which is the same or bigger that the space covered by said chair under the frame and a set of rigid rods which define the respective mounting supports of the side poles. The rods of said mounting supports have a horizontal segment which define a coupling tip to the chair or deck chair and a coupling tip to the corresponding side pole. On a segment of the length of the side poles and between them, is mounted in a retractile way by means of knots made by "hoop & loop" like fabric strips, a cover to prevent either partially or fully the sunrays from hitting the space occupied by the chair or deck chair. In this way, the cover can be moved along the side poles according to the variations in the direction of the sunrays to get the amount of shade the user wants.

7 Claims, 4 Drawing Sheets

U.S. PATENT DOCUMENTS 6,202,665 B1 * 3/2001 O'Hare ..... 135/90
6,276,382 B1 * 8/2001 Bindschatel et al. ..... 135/96
6,296,002 B1 * 10/2001 Tashchyan ..... 135/96
6,402,220 B2 * 6/2002 Allen ..... 296/77.1
6,431,192 B2 * 8/2002 O'Hare ..... 135/125
6,510,565 B1 * 1/2003 Zwezdaryk ..... 4/531
6,682,142 B1 * 1/2004 Tseng ..... 297/246
6,823,883 B1 * 11/2004 Sears ..... 135/128
7,066,526 B2 * 6/2006 Weddington et al. ..... 296/105
7,243,990 B1 * 7/2007 Wahl ..... 297/184.15
D555,748 S * 11/2007 Gyr et al. ..... D21/837
2001/0009158 A1 * 7/2001 O'Hare ..... 135/90
2006/0284457 A1 * 12/2006 Holley ..... 297/184.15
2008/0018146 A1 * 1/2008 Wahl ..... 297/184.15

* cited by examiner

CANOPY FRAME PARTICULARLY APPLICABLE TO DECK CHAIRS, GARDEN CHAIRS, BEACH CHAIRS AND THE LIKE

FIELD OF THE INVENTION

The present Utility Model refers to a canopy frame particularly applicable to deck chairs, garden chairs, beach chairs and the like and most particularly a canopy frame that is easy to be assembled, disassembled and carried by the user wherever and whenever they like which can also be used in a simple way to protect oneself from the sun or the wind.

BACKGROUND OF THE PRIOR ART

Within the prior art in the subject there are traditional garden umbrellas or parasols similar to the ordinary umbrellas as well as other frames especially designed to be used as a complement to tents of different sizes and construction which are assembled at the front of the tents as an extension.

It would be redundant to make more detailed comments on said umbrellas and complementary frames for tents since they have been in the market for many years and as it will be stated further on, they are not relevant antecedents to the state-of-the-art canopy frame which is the object of the present utility model.

Among the most remarkable advantages of this canopy frame particularly applicable for deck chairs, garden chairs, beach chairs and the like, it is worth mentioning apart from the fact that it is undoubtedly a novelty and comfortable to use, it is easy to assemble by simply coupling its parts and mainly the fact that the user can adapt its position at any time according to the direction of the sunrays without moving the frame and/or the chair.

In fact, as the direction of the sunrays changes during the day, you just need to move the retractable cover on the upper part of the frame and it can be done by any person regardless of their physical strength which is a remarkable advantage to the ordinary parasols.

SUMMARY OF THE INVENTION

The reason for this present utility model is to provide a canopy frame particularly applicable for deck chairs, garden chairs, beach chairs and the like being a frame which can be easily assembled and disassembled in the place itself to be used and carried by the user. It comprises a primary set of rods which define the corresponding side poles which are extended like an arc on opposite sides of the chair or deck chair and separated between each other by a distance which is at least the width or the length of said chair under the frame and a secondary set of rods which are the corresponding mounting supports of said poles to the chair or deck chair, and it is mounted, in a retractable way, on at least one segment of the length of said side poles and between them there is at least one cover which is able to partially or fully prevent the sunrays from hitting the space occupied by the chair or deck chair.

BRIEF DESCRIPTION OF THE DRAWINGS

To understand and show the object of the present utility model more clearly it has been illustrated in different pictures which represent the most suitable ways to manufacture it, only as an example in which.

DETAILED DESCRIPTION OF THE INVENTION

Figure 1:
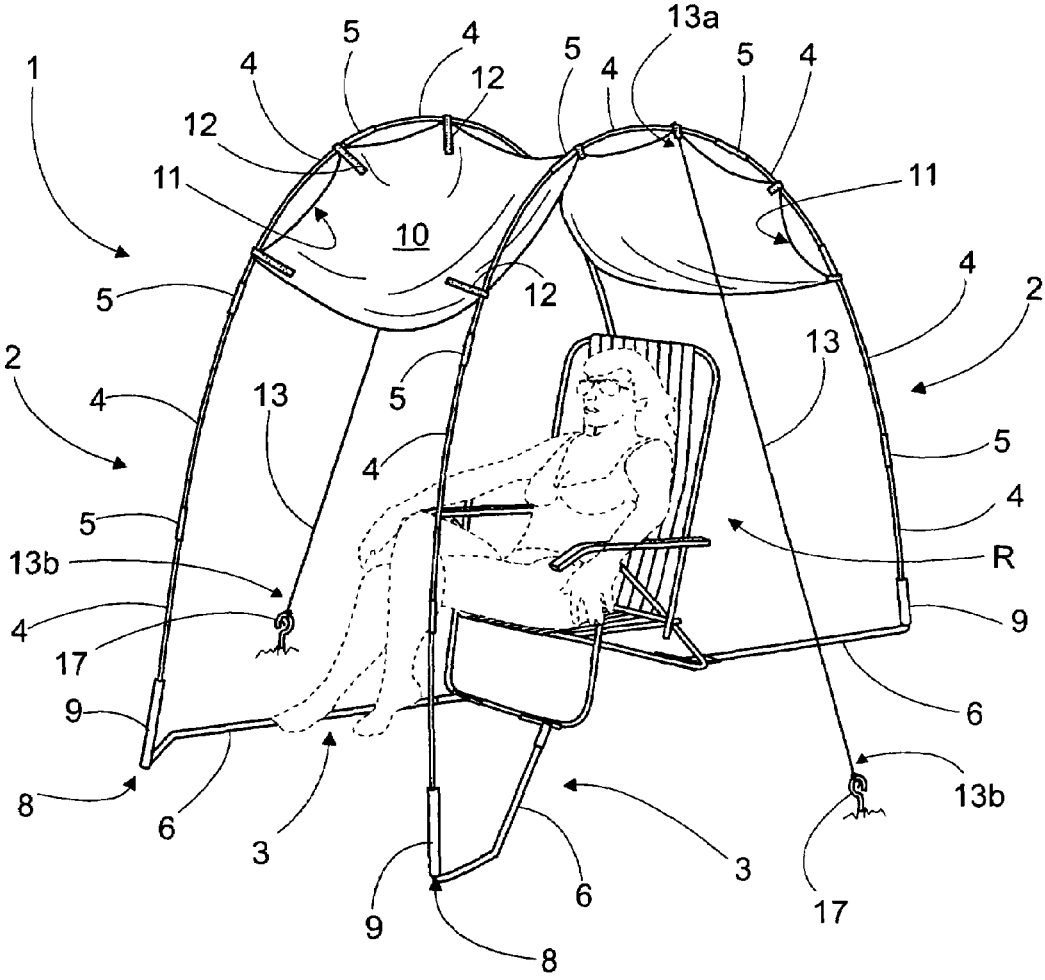
FIG. 1 is a prospective front view of the canopy frame which is the object of the present utility model.
Figure 2:
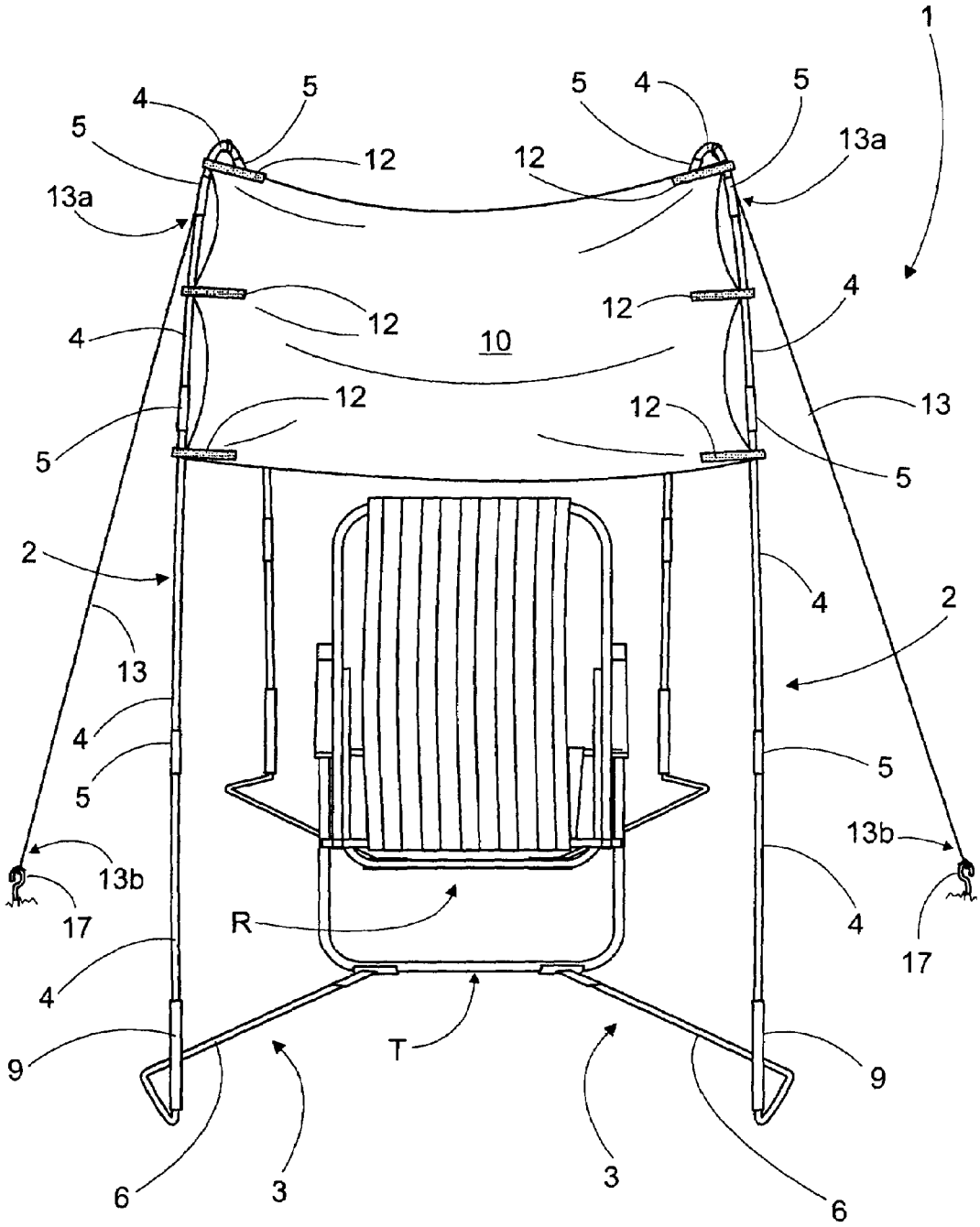
FIG. 2 is a prospective back view of the canopy frame which is the object of the present utility model shown in Picture 1.

Describing in the first place FIGS. 1 and 2 it can be seen that this canopy frame marked with the general reference number 1 and applied to this example to an R deck chair, has a primary set of rods which define the respective side poles (2), which extend in an arc on each side and over said R deck chair and a secondary set of rods with which mounting supports (3) are defined for said poles (2) and the fixing of frame (1) to the R deck chair. As shown, the side poles (2) are separated from each other by a distance that widely allows for the space occupied by the R deck chair under frame (1). Each of said side poles (2) is defined by a succession of flexible rod segments (4) coupled like an axle with tubular pieces 5 "male & female" preferably threaded.

At the same time, the mounting supports (3) comprise pairs of rods respectively located on opposite sides of the R deck chair and matching the location of the tips of each side pole (2). Each of said mounting supports (3) comprises a horizontal segment (6) where a first tip (7) that can be coupled to the R deck chair and a second tip (8) that can be coupled to the corresponding tip of the matching side pole (2) are defined. Said second tip (8) of the mounting supports (3) is defined by a tubular segment (9) essentially perpendicular to the horizontal segment (6) where the corresponding tip of the side pole (2) fits.

On top of the upper pair of the side poles (2) there is a retractable cover (10) between them made of canvas, a shade cloth or any other cover capable of partially or fully preventing the sunrays from reaching the space occupied by the R deck chair. It is worth pointing out that, as will soon be understood, although said cover (10) is shown in the picture at the top and in the middle of the frame (1) in practice it can be placed in any other positions along the poles (2) according to what the user needs of prefers with regard to the direction of the sunrays from which they want to protect themselves as well as the direction of the wind if applicable. For this purpose, said retractable covering (10) is fixed to both side poles (2) from its opposite tips (11) by means of knots defined by "hoop and loop" fabric strips (12). In this way, the cover (10) can be easily retracted at will from one position into another.

Additionally in order to make the frame (1) more mechanically resistant in case of medium or strong winds, it is fastened by means of a set of ropes (13) which stabilize the side poles (2). Said ropes (13) have a primary tip (13*a*) or upper tip fixed to the corresponding side pole (2) and a secondary tip (13*b*) or lower tip fixed to the ground by means of a stake (17). Besides, as a complementary frame stabilizer (1) extra stakes are supplied to fix it to the ground from the side poles (2) mounting supports (3). Said stakes (18) are shown in picture 4 which will be further referred to.

Figure 3:
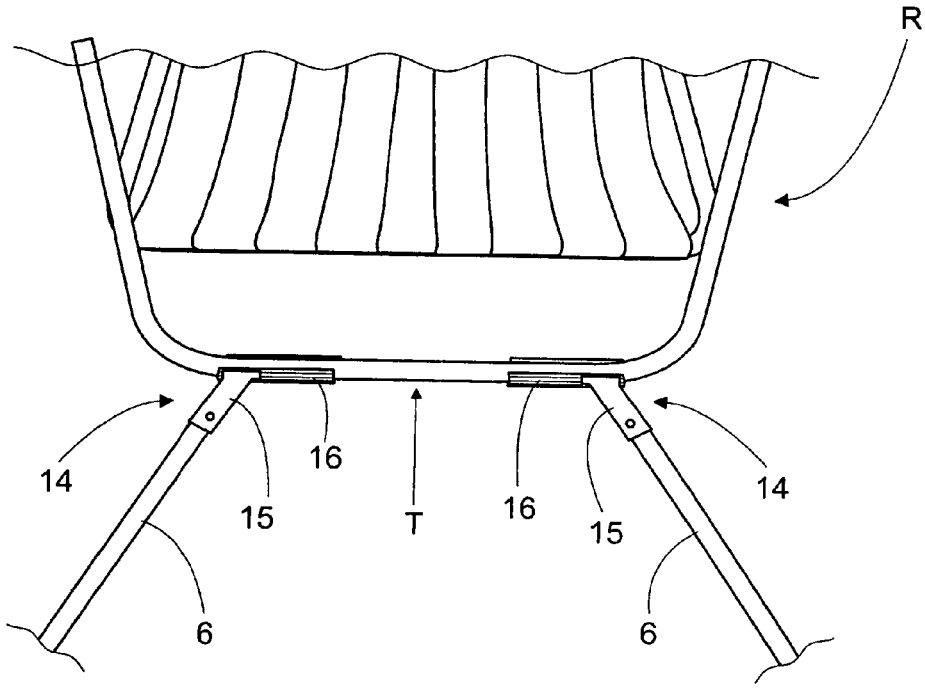
FIG. 3 is a detailed version of the bottom of a garden or beach chair and the way in which the canopy frame is fixed to it.

In FIG. 3 the construction specifications of the mounting supports (3) for its coupling to the R deck chair can be clearly seen. In fact, as illustrated, showing the deck chair in opposite sides thereof respective T ground supporting rods. Tip (7) of rods (6) is fixed to the corresponding T rod by means of a coupling piece (14) that has a fixable primary segment (15) to said tip (7) for example, by means of a screw or cylindrical bolt and a secondary segment (16) essentially a split pipe, on which the T rod rests. In this way, the structure (1) as a whole, is also well fixed against the ground because of the weight of the R deck chair itself and even more, when there is a user sitting or lying there.

Figure 4:
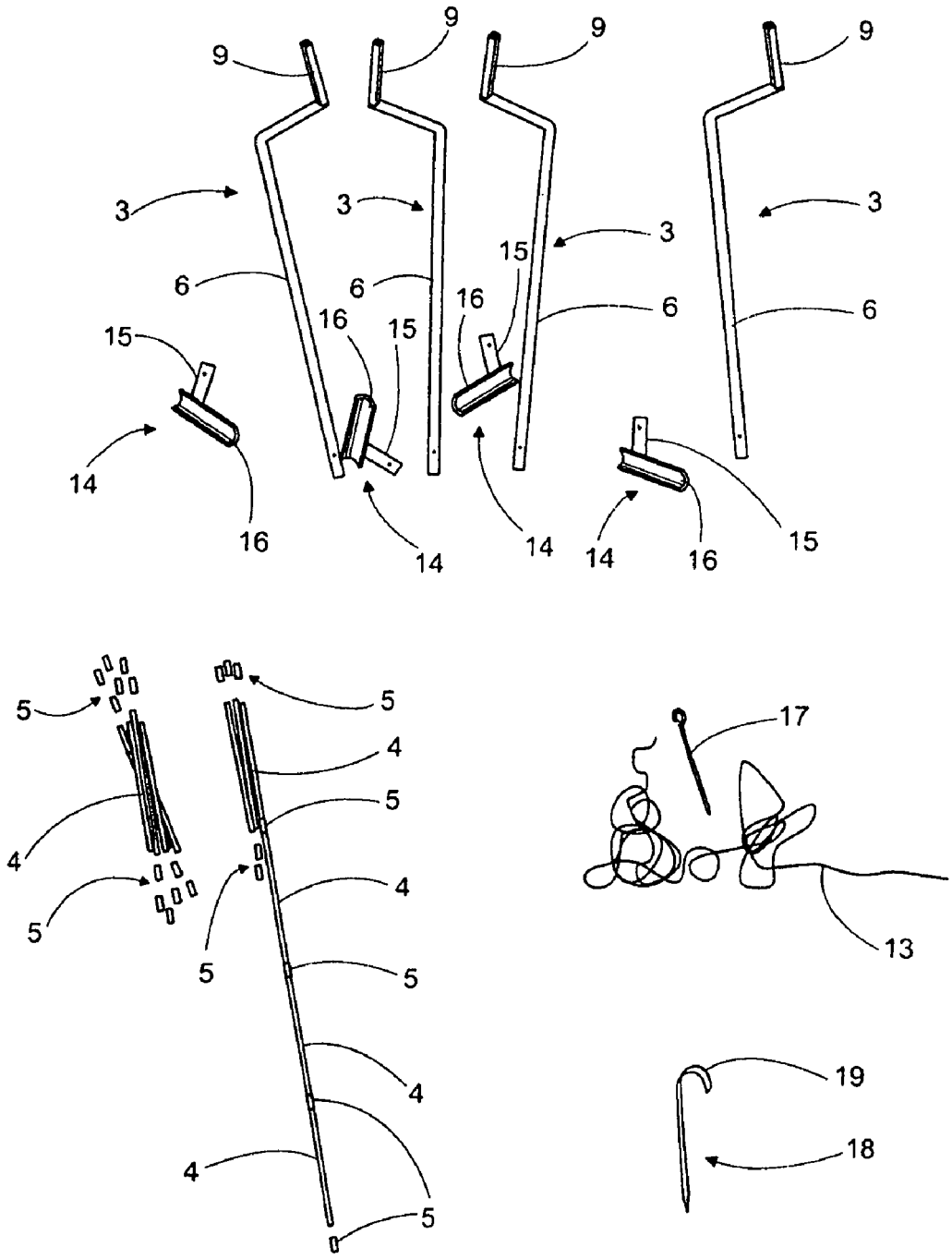
FIG. 4 shows the pieces and the sets with which the canopy frame, object of this present utility model, is assembled.

In FIG. 4 where the set of pieces that form the frame which is the object of this present utility model is shown, the shape of the flexible rods (4) that as a whole define each of the side poles (2) the rigid rods (6) that define each of the mounting supports (3) together with the coupling pieces (14) can clearly be seen as well as the shape of the stakes (17) to fix to the ground the stabilizing ropes (13) and the stakes (18) that can be used additionally to fix the frame against the ground coupling the rigid rods (6) to the concave tip (19) of said stakes (18).

Having described and defined the nature of the present utility model and the way it is going to be made, the following property and exclusive rights are claimed:

1. A canopy in combination with a chair comprising:

a pair of side poles, wherein each of the side poles is formed by a plurality of flexible rod segments interconnected with each other, wherein each side pole has a length that is adjustable;

a plurality of mounting supports, each mounting supports comprising a rigid rod;

the chair having a bottom frame and an upper frame;

wherein each of the side poles extends in an arc on opposite sides and over the chair;

wherein each of the side poles comprises a first end and a second end, each end having a tip, wherein the side poles are separated from each other by a distance, the distance being at least the width or the length of said chair;

wherein the rigid rods of the plurality of mounting supports are located at opposite sides of the chair, each of the rigid rods including a horizontal segment having a first tip coupled to the bottom frame of the chair and a second tip coupled to a corresponding one of the tips of the pair of side pole;

wherein the second tip of each horizontal segment is coupled to the corresponding one of the tips of the pair of side poles by a tubular segment extending perpendicular to the horizontal segment;

wherein connected on at least one of the flexible rod segments of said side poles and extending between the pair of side poles is at least one cover;

wherein the first tip of each rigid rod is coupled to the chair by means of a coupling piece; and wherein said covering is fixed in a retractable way to each side pole from two opposite edges by means of hoop and loop fabric strips.

2. The canopy according to claim 1, wherein said flexible rod segments are interconnected with each other by using tubular coupling "male & female" pieces.

3. The canopy according to claim 2, wherein the "male & female" interconnection between said tubular pieces is threaded.

4. The canopy according to claim 1, further including ground fixing stakes of said mounting supports of the side poles.

5. The canopy according to claim 1, wherein the bottom frame includes a pair of legs, each leg having a supporting cross rod configured to extend parallel to and rest upon a supporting surface; and wherein the coupling piece is U-shaped such that the coupling piece partially surrounds and supports one of the supporting cross rods.

6. A canopy in combination with a chair comprising:

a pair of side poles, wherein each of the side poles is formed by a plurality of flexible rod segments interconnected with each other, wherein each side pole has a length that is adjustable;

a plurality of mounting supports, each mounting supports comprising a rigid rod;

at least one pair of stabilizing ropes, each of said ropes having a primary fixing end connected to a corresponding one of the side poles and a secondary tip that can be fixed to the ground by means of a corresponding stake;

the chair having a bottom frame and an upper frame;

wherein each of the side poles extends in an arc on opposite sides and over the chair;

wherein each of the side poles comprises a first end and a second end, each end having a tip, wherein the side poles are separated from each other by a distance, the distance being at least the width or the length of said chair;

wherein the rigid rods of the plurality of mounting supports are located at opposite sides of the chair, each of the rigid rods including a horizontal segment having a first tip coupled to the bottom frame of the chair and a second tip coupled to a corresponding one of the tips of the pair of side pole;

wherein the second tip of each horizontal segment is coupled to the corresponding one of the tips of the pair of side poles by a tubular segment extending perpendicular to the horizontal segment;

wherein connected on at least one of the flexible rod segments of said side poles and extending between the pair of side poles is at least one cover;

wherein the first tip of each rigid rod is coupled to the chair by means of a coupling piece;

wherein the bottom frame includes a pair of legs, each leg having a supporting cross rod configured to extend parallel to and rest upon a supporting surface;

wherein the coupling piece is U-shaped such that the coupling piece partially surrounds and supports one of the supporting cross rods.

7. A canopy in combination with a chair consisting of:

a pair of side poles, wherein each of the side poles is formed by a plurality of flexible rod segments interconnected with each other, wherein each side pole has a length that is adjustable;

a plurality of mounting supports, each mounting supports comprising a rigid rod;

the chair having a bottom frame and an upper frame;

wherein each of the side poles extends in an arc on opposite sides and over the chair;

wherein each of the side poles comprises a first end and a second end, each end having a tip, wherein the side poles are separated from each other by a distance, the distance being to be at least the width or the length of said chair;

wherein the rigid rods of the plurality of mounting supports are located at opposite sides of the chair, each of the rigid rods including a horizontal segment having a first tip coupled to the bottom frame of the chair and a second tip coupled to a corresponding one of the tips of the pair of side pole;

wherein the second tip of each horizontal segment is coupled to the corresponding one of the tips of the pair of side poles by a tubular segment extending perpendicular to the horizontal segment;

wherein connected on at least one of the flexible rod segments of said side poles and extending between the pair of side poles is at least one cover;

wherein the first tip of each rigid rod is coupled to the chair by means of a coupling piece;

wherein the bottom frame includes a pair of legs, each leg having a supporting cross rod configured to extend parallel to and rest upon a supporting surface;

wherein the coupling piece is U-shaped such that the coupling piece partially surrounds and supports one of the supporting cross rods.

* * * * *